United States Patent [19]

Emele et al.

[11] Patent Number: 4,632,568

[45] Date of Patent: Dec. 30, 1986

[54] STATIC MIXING COLUMN

[75] Inventors: Edgar F. Emele, Augsburg; Nikolaus Brugner, Ziemetshausen, both of Fed. Rep. of Germany

[73] Assignee: Ritter-Plastic GmbH, Fed. Rep. of Germany

[21] Appl. No.: 739,030

[22] Filed: May 29, 1985

[30] Foreign Application Priority Data

May 30, 1984 [DE] Fed. Rep. of Germany ..... 3420290

[51] Int. Cl.[4] ..... B01F 5/00

[52] U.S. Cl. ..... 366/337; 366/336; 366/338; 366/340

[58] Field of Search ..... 366/336–340, 366/341; 138/38, 42; 48/180 R, 180 B

[56] References Cited

U.S. PATENT DOCUMENTS

| | | | |
|---|---|---|---|
| Re. 28,072 | 7/1974 | Sluijters | 366/337 |
| 3,328,003 | 6/1967 | Chisholm | 366/337 |
| 3,881,701 | 5/1975 | Schoenmann et al. | 366/340 X |
| 4,112,520 | 9/1978 | Gilmore | 366/337 |
| 4,316,673 | 2/1982 | Speer | 366/337 |
| 4,560,284 | 12/1985 | Chen | 366/337 X |

FOREIGN PATENT DOCUMENTS

| | | |
|---|---|---|
| 7733456 | 5/1978 | Fed. Rep. of Germany . |
| 3214056 | 4/1982 | Fed. Rep. of Germany . |

*Primary Examiner*—Timothy F. Simone

*Attorney, Agent, or Firm*—Ostrolenk, Faber, Gerb & Soffen

[57] ABSTRACT

An improved mixing column for mixing a plurality of liquid or paste-like components of a material has several tiers having at least two flow-division chambers which overlap each other at least partially, and where each of these superimposed flow-division chambers has a flow-division wall which divides the incoming fluid. A different passage opening of the tier is connected with each of the superimposed flow-division chambers. The flow-division chambers are connected to mixing chambers arranged on either side thereof. Successive tiers are oriented at 90° with respect to each other and each successive tier is shifted an additional 90° in the same direction of rotation such that the mixing chambers of a lower tier are in communication with the passage openings in the floor of the adjacent upper tier. In this way, improved mixing of the components is achieved with a more compact construction as well as simplified manufacture.

9 Claims, 16 Drawing Figures

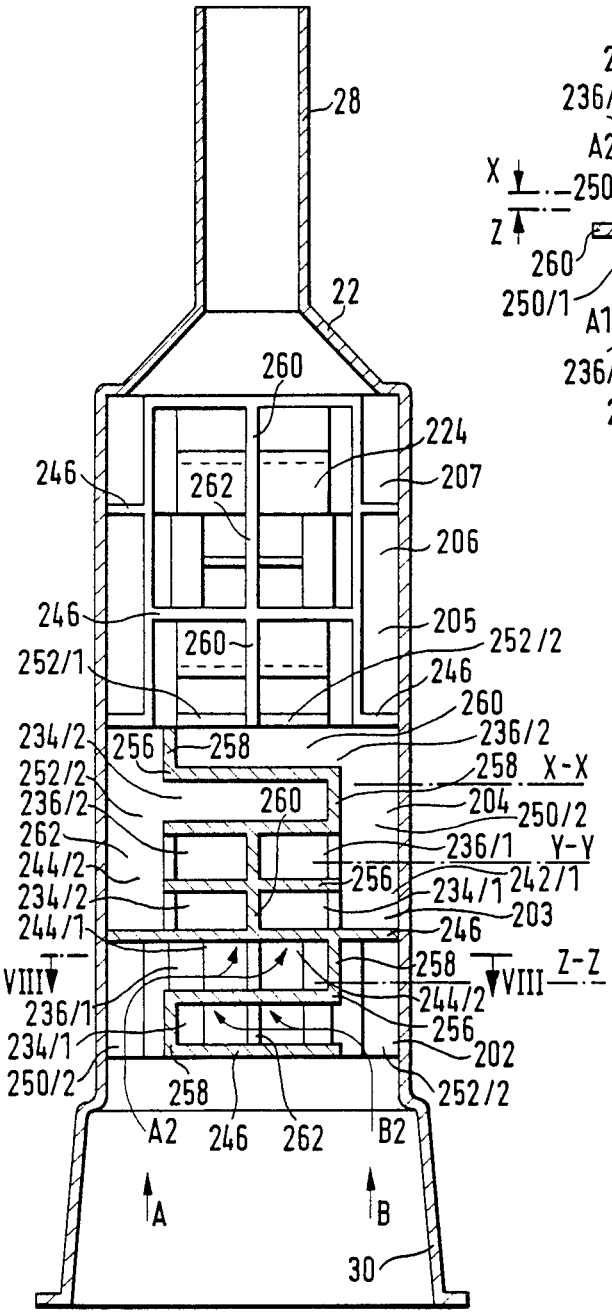
FIG. 7
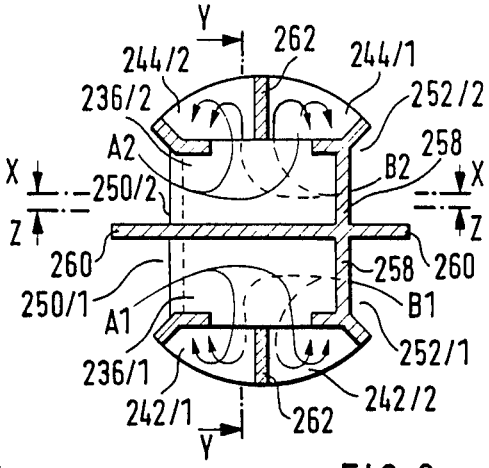
FIG. 8
FIG. 15
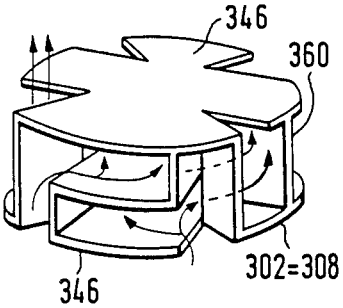
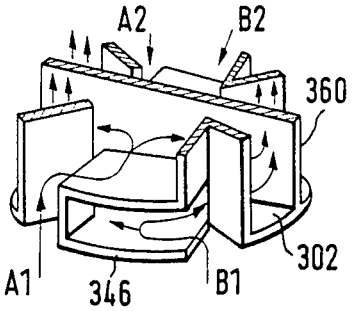
FIG. 14

FIG.9
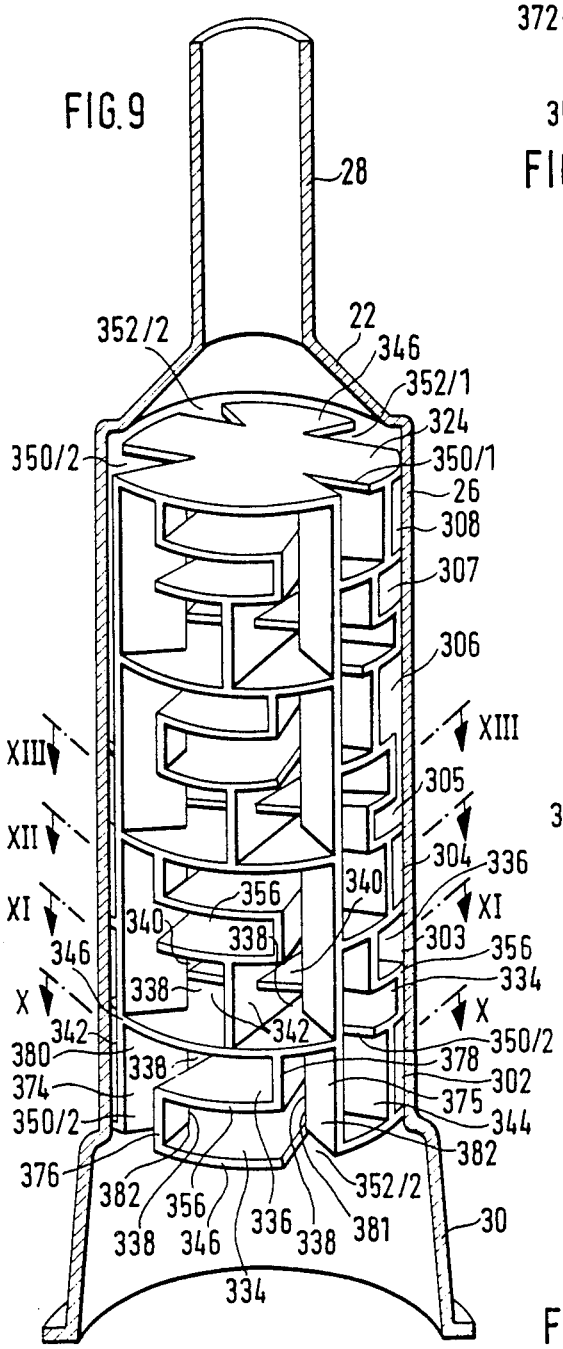
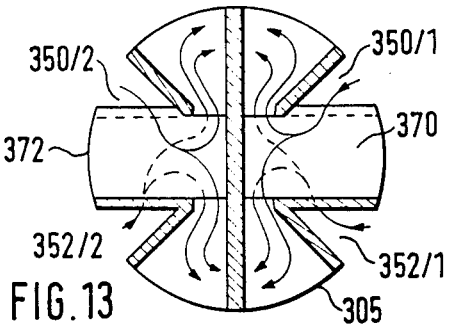
FIG.13
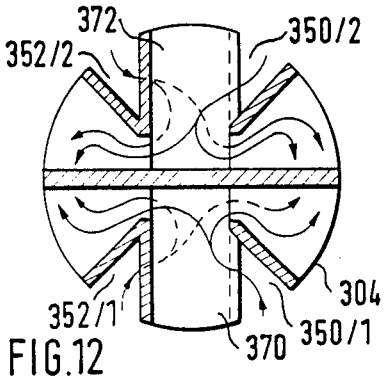
FIG.12
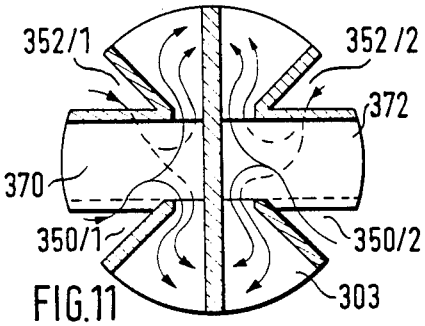
FIG.11
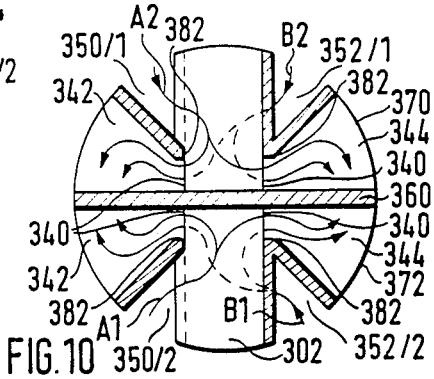
FIG.10

STATIC MIXING COLUMN

BACKGROUND OF THE INVENTION

The present invention relates to a static mixing column for the mixing of a plurality of liquid or paste-like components of a material, having a plurality of tiers. The tiers have floors with passage openings and walls for dividing the components of a material into individual parts and recombining these individual parts to form new mixtures.

In the static mixing equipment disclosed in Federal Republic of Germany Unexamined Application OS No. 32 14 056 and Federal Republic of Germany Utility Model No. 77 33 456, the tiers are formed by individual elements which are stacked one on top of the other to form a column. In the first-mentioned patent, the successive elements are shifted at an angle of 90° from each other. In both cases, the division of fluid input into individual branches takes place on the opposite boundary surfaces of two consecutive elements. The number of elements required to form a tier depends on how frequently the branches are divided and recombined with each other. The mixing elements are positioned in a cylindrical nozzle which serves to combine a plurality of components of a material received from containers or reservoirs such that they react with one another prior to application. The point of application may be a surface to be bonded, a slit to be sealed, a cavity to be filled, etc., depending on whether the components of the material are adhesive, sealing material or filler for the filling and insulating of cavities. Generally, there are two components which are stored separately and are effective only when brought into contact with each other. Base material may, for instance, be epoxy resin, polyurethane, silicone, etc., as well as a specific activator adapted thereto, such as isocyanate, for instance.

SUMMARY OF THE INVENTION

An object of the invention is to avoid the time-consuming stacking of the individual mixing elements on each other to form a column.

Another object of the invention is to provide better mixing of the components with a shorter column.

These objects, as well as others not enumerated herein are achieved in accordance with the invention by a series of tiers wherein in each tier there are at least two flow-division chambers situated one above another at least in some overlapping area; that each of these superimposed flow-division chambers has a flow division wall which divides the incoming fluid; that another passage opening in the tier floor is in communication with each of the superimposed flow-division chambers; that the flow-division chambers are in communication with mixing chambers positioned on either side of the flow-division chambers; and that the successive tiers are oriented at 90° angles with respect to one another and further that for each successive tier, the tier is shifted an additional 90° in the same direction of rotation such that the mixing chambers of a lower tier are in communication with the passage openings of the tier floor of the next adjacent upper tier.

In accordance with the invention, the division of fluid input components into individual branches and the recombination of the individual branches to form new branches takes place within the individual tiers. In this way, the first and last tiers of the column are also fully active, so that the required height of the column is smaller than that of the prior art. For the same height of a column, greater mixing is achieved by the invention. By arranging the flow-division chambers substantially above each other and by positioning the mixing chambers on either side of the flow-division chambers, an entire column of several tiers can be manufactured in a single integral unit by molding casting. In this manner, the time-consuming stacking of individual tiers by hand, as now required is dispensed with.

The components of the material to be mixed can be fed into the mixer separately or combined in a single input. Upon entrance into the mixing column, each fluid input can then be divided into two, four, or more parts and them combined with each other in a new combination to form new fluid branches and then again redivided.

Further features of the invention are set forth in the claims.

BRIEF DESCRIPTION OF THE DRAWINGS

Various embodiments of the invention will be described below, by way of example, with reference to the drawings, in which:

FIG. 7 is a partial axial sectional view of another embodiment of a static mixing column according to the invention;

FIG. 8 is a sectional view along the plane VIII—VIII of FIG. 7;

FIG. 9 is a perspective view of another embodiment of a static mixing column according to the invention;

FIG. 10 is a cross-sectional view along the plane X—X of FIG. 9;

FIG. 11 is a cross-sectional view along the plane XI—XI of FIG. 9;

FIG. 12 is a cross-sectional view along the plane XII—XII of FIG. 9;

FIG. 13 is a cross-sectional view along the plane XIII—XIII of FIG. 9;

FIG. 14 is a perspective view of the lowermost tier of the mixer column of FIG. 9;

FIG. 15 is a perspective view of the uppermost tier of the mixer column of FIG. 9.

DESCRIPTION OF PREFERRED EMBODIMENTS

Figure 1:
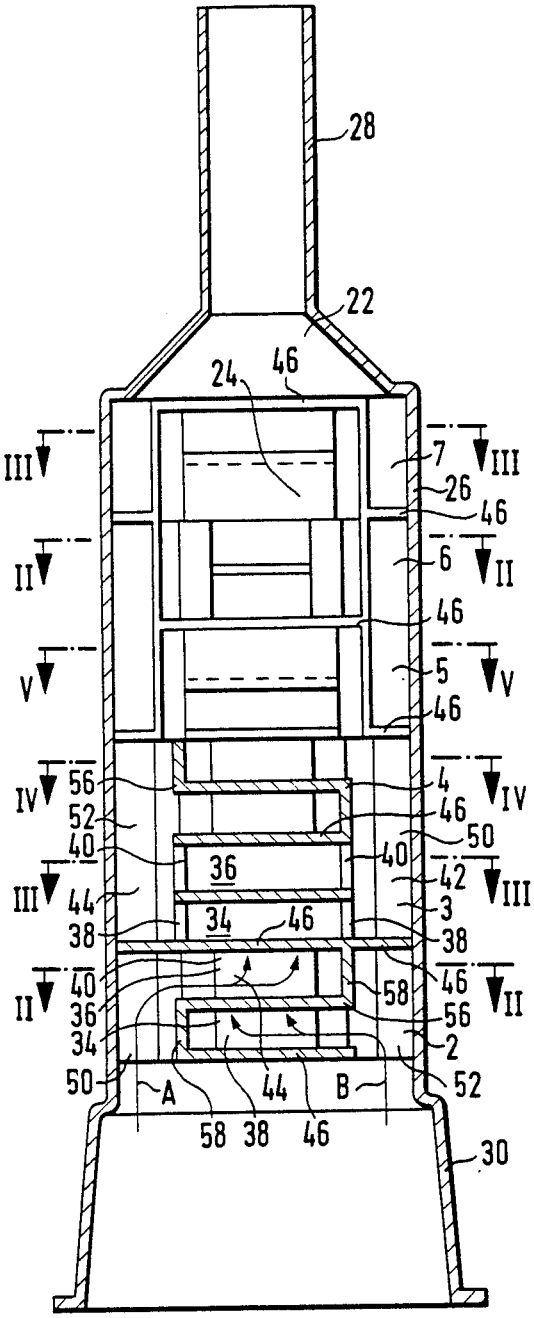
FIG. 1 is a partial axial sectional view of a static mixing column according to the invention.
Figure 5:
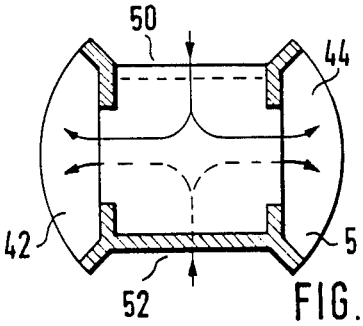
FIG. 5 is a sectional view along the plane V—V.
Figure 4:
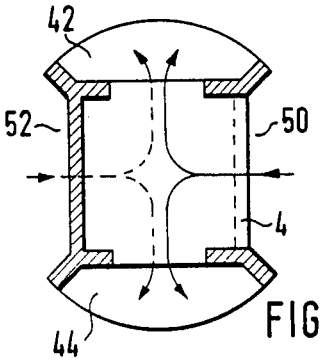
FIG. 4 is a sectional view along the plane IV—IV.
Figure 3:
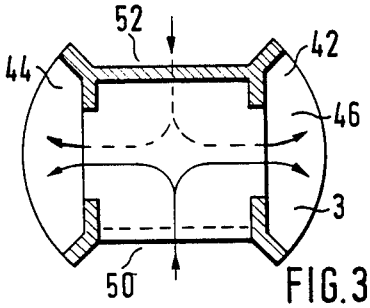
FIG. 3 is a sectional view along the plane III—III of FIG. 1.
Figure 2:
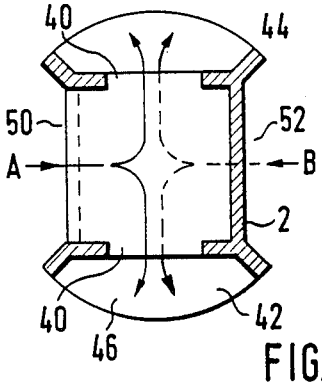
FIG. 2 is a sectional view along the plane II—II of FIG. 1.

The static mixing column illustrated in FIGS. 1 to 6 consists, as shown in FIG. 1, of a nozzle 22 and a mixing column 24 arranged in a cylindrical housing 26 which is part of the nozzle 22. The nozzle 22 has a nozzle outlet connection 28 on its downstream end and a connecting socket 30 on its upstream end, which can be placed on a container from which, for instance, two components can be dispensed.

The mixing column 24 consists of several tiers 2, 3, 4, 5, 6, and 7 arranged one above the other, all being of identical design, with each tier being angularly displaced with respect to each other, each angular displacement being in the same direction of rotation for each successive tier. Each tier has at least two flow-division chambers 34 and 36, arranged substantially one above the other, and mixing chambers 42 and 44 positioned on either side of each flow-division chamber and communicating with each through lateral openings 38 and 40. The mixing chambers 42 and 44 extend over the entire height of the tier and thus also over the entire height of two superimposed flow-division chambers 34 and 36 in each tier. Each tier 2, 3, 4, 5, 6, and 7 has a tier floor 46 having an entrance having two passage openings 50 and 52, one of which in each case leads to one of the two flow-division chambers 34 and 36. The passage opening 50 extends from the floor of tier past the lower flow-division chamber 34, up to the upper flow-division chamber 36. The flow-division chambers 34 and 36 are separated from each other by a substantially "S"-shaped or "Z"-shaped partition wall 56 or a partition wall. The successive tiers are all of identical design but are oriented at 90° with respect to each other. In this manner, the partition walls 56 of the tiers 2, 4, and 6 are mirror images of one another, as are the tiers 3, 5, and 7, such that tier 2 has the shape of an inverted "S" while the partition wall 56 in tier 4 has the shape of a normal "S". With this configuration, all flow paths within the mixing column are of the same length. Furthermore, as a result, the sequence of the combined individual streams is reversed and thus better mixing is achieved.

The vertical sections 58 of the partition walls 56 form flow-division walls against which the fluid inputs A and B impinge and are thereby divided into individual branches. The branches of components of the material A which enters into the upper flow-division chamber 36 flows against the flow-division wall 58 and is divided and directed in opposite directions, and the individual branches which are thus formed flow in opposite directions through the lateral openings 40 into the mixing chambers 42 and 44, which function as an exit for the tier. The component branch B enters the lower flow-division chamber 34 and impinges against its flow-division wall 58, dividing into two individual branches flowing in opposite directions away from each other through lateral openings 38 into the mixing chambers 42 and 44. In the mixing chambers 42 and 44, the individual branches of the original fluid inputs A and B are combined with each other and then pass through passage openings 50 and 52 in the tier floor 46 of the adjacent upper tier, e.g., tier 3, into the flow-division chambers 34 and 36 of tier 3, where the process of dividing the incoming fluid inputs and then recombining them occurs once again.

Tiers 2, 3, 4, and 5 are illustrated in cross-sectional top view in FIGS. 2, 3, 4, and 5. They are identical in design but each oriented at 90° rotation with respect to one another, each successive tier being shifted an additional 90°. In this manner, the tiers 6 and 7 are oriented in the same manner as the tiers 2 and 3 corresponding to FIGS. 2 and 3. The uppermost tier 7 is also provided with a top tier floor 66 which is shifted 90° with respect to the lower tier floor 46, corresponding to what would constitute tier 8, such that the two incoming fluid inputs are divided into individual branches and then are recombined to form new branches prior to leaving the uppermost tier floor and passing into the outlet connection 28.

Figure 6:
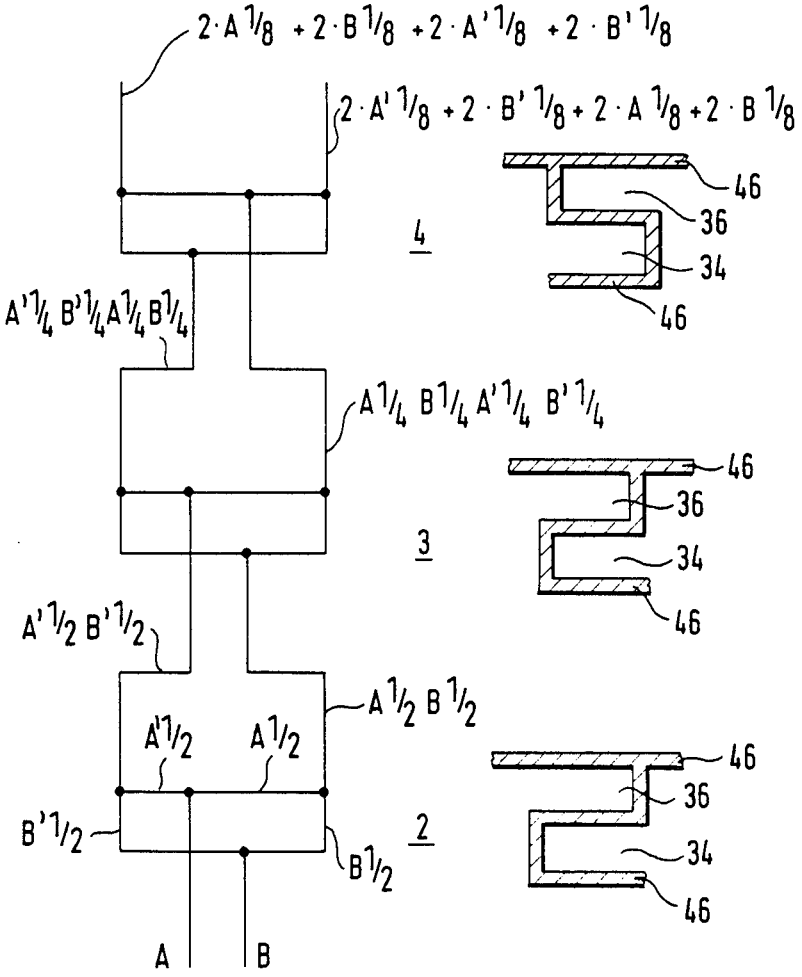
FIG. 6 is a schematic diagram of the path of flow of the components in the static mixing column of FIGS. 1 to 5.

FIG. 6 illustrates tiers 2, 3, and 4 side-by-side with a schematic representation of the flow paths of the two components A and B of the input material. From this, it can be seen that in the lowermost tier 2 the two fluid inputs A and B, each of which is divided into individual branches of approximately one-half the volume, e.g., A $\frac{1}{2}$, A' $\frac{1}{2}$, B $\frac{1}{2}$, and B' $\frac{1}{2}$, are recombined to form new branches, each of which consists of half the original input A and half of the original input B. In the next tier 3, a division of the individual branches and a recombination of those individual branches into new branches takes place in the same manner. It can be seen that the new branches leaving the second tier 3 consist of four individual branches. The branches leaving the third tier 4 comprise eight individual branches.

From FIG. 1 it can be readily seen that the entire mixing column 24, including the flow-division chambers 34, 36, the mixing chambers 42 and 44, the openings 38 and 40 between these chambers, the tier floors 46, and the passage openings 50 and 52 comprise a single integral unit and that the structure is open towards the cylindrical periphery of the mixing column 24. The cylindrical periphery of the mixer column 24 is hermetically sealed within the cylindrical housing 26 of the nozzle 22. It is therefore possible to manufacture the mixing column 24 as a single unit by injection molding and to perform the required manufacturing operations from the periphery of the mixing column 24 in order to form the chambers and openings therein.

The mixing column 24 itself is also of cylindrical shape, conforming to the cylindrical housing part 26.

The preceding description of the embodiment according to FIGS. 1 to 6 applies by analogy to further embodiments of the invention, some of which are illustrated in FIGS. 7 to 16, so that only those differences with respect to the preceding embodiment will be noted during the following discussion of these additional embodiments.

In FIGS. 7 and 8, the reference numbers utilized in FIGS. 1-6 and increased by 200 are used for corresponding parts of the preceding embodiment. The embodiment of FIGS. 7 and 8 differs from the embodiment shown in FIGS. 1 to 6 by the inclusion of a partition wall 260 extending through the central axis of the mixer column 224 over the entire height and diameter of each tier, dividing the superimposed flow-division chambers 234 and 236 into adjacent individual flow-division chambers or chamber subsections 234/1, 234/2, 236/1, and 236/2. Furthermore, the mixing chambers 42 and 44 are divided by vertical partition walls 262 into adjacent individual mixing chambers 242/1, 242/2, and 244/1, 244/2. The partition walls 262 are aligned in the individual tiers with the partition walls 260 of the adjacent tiers, since successive tiers are oriented at 90° angles with respect to each other. This embodiment also consists of a single integral unit, preferably plastic, and can be produced by injection molding.

The vertical cross-section illustrated in FIG. 7 extends through the lowermost tier 202 behind the partition wall 260 corresponding to the section indication Z—Z in FIG. 8. In the third tier 204, the vertical section in FIG. 7 extends as indicated by the section indication X—X in FIG. 8. The upward sectional view of the second tier 203 illustrated in FIG. 7 extends along the section plane Y—Y of FIG. 8. The partition walls 260 extend beyond the passage openings of the tier floors 246 and thereby divide each of these passage openings in two, designated 250/1, 250/2, 252/1 and 252/2 in FIGS. 7 and 8.

The partition walls 260 and 262 result in a division into two individual branches A1 and A2, as well as B1 and B2, of the fluid component A of the fluid component stream B. These individual branches are again divided upon leaving the flow-division chambers 234/1, 234/2, 236/1 and 236/2 by the other partition wall 262. In the mixing chambers 242/1, 242/2 and 244/1 and 244/2, two individual branches are recombined to form a new branch which in the following tier is again divided four times in the same manner as in the preceding tier and recombined to form a new combination. In this way, twice as large a mixture ratio is obtained in the embodiment shown in FIGS. 7 and 8 as in the embodiment of FIGS. 1 to 6.

Similarly, a quadruple division of the individual branches and recombination to form newly combined branches is achieved by the embodiment of the invention shown in FIGS. 9 to 16.

In the embodiment of FIGS. 9 to 16, parts which correspond to the embodiments described above have been provided with the same reference numbers increased by 300. Only the nozzle 222 and its outlet connection 28, cylindrical housing 26 and connecting socket 30 have been provided with the same reference numbers since they are identical in the preceding embodiments. The invention, a mixing column generally designated by reference numeral 324 is again of single-piece construction, made preferably by injection molding from plastic. It has a plurality of tiers 302, 303, 304, 305, 306, 307, and 308. FIGS. 10, 11, 12 and 13 show downward looking cross-sectional views along the planes X, XI, XII, and XIII. It should be noted that all tiers are of identical design but are arranged one above the other and displaced at successive 90° angles with respect to each other in the same direction of rotation. The tier 302, at the bottom, is illustrated in FIG. 10. The tiers 303, 304, and 305 are similarly shown in FIGS. 11, 12, and 13. The uppermost tier 308 differs from the tiers below it, in that there is an additional tier floor 346 displaced 90° with respect to its lower tier floor. In this way, the incoming fluid branches are divided into individual branches in the uppermost tier 308 and are recombined to form new branches which flow through the passage openings 350/1, 350/2 and 352/1, 352/2 in the top tier floor 346 which serves as cover. The branches of component flowing through the connection socket 30 of the nozzle 32, and through the passage openings in the tier floor 346 are divided into four individual branches A1, A2, B1, and B2, A and B being the original two fluid components which are introduced through the connection socket 30. Therefore, in each tier 302 to 308 there is a division of the fluid branches into four individual branches and a recombination to form new branches. The passage openings 350/1, 350/2, 352/1 and 352/2, viewed in cross-section, have a substantially triangular cross-sectional shape with a triangle vertex directed towards the longitudinal axis of the mixing column 224.

Each tier is divided by a diametrically extending flow division wall into two adjacent regions 370 and 372. In the tier floor 346, the passage openings 350/1 and 350/2 are in one region and the passage openings 352/1 and 352/2 are in the other region. The passage openings of the tier floors lead in each tier to superimposed flow-division chambers 334 and 336. Between the superimposed flow-division chambers of each tier there are "S"-shaped or "Z"-shaped partition walls 356. Adjoining the passage openings 350/1, 350/2, 352/1 and 352/2, there are channels 374 and 375 leading to the flow-division chambers 334 and 336 which are defined by vertical arms 376 and 378 of the partition wall 356 and by the side walls 380 and 382. The side walls 380 and 382 extend parallel to the central axis of the mixing column 346 throughout the entire height of the mixing column 346 and radially to the central axis of the column. The vertical arms 376 and 378 of the partition wall 356 are staggered but parallel to each other. The arms 376 and 378 and the side walls 380 and 382 continue towards the edges of the passage openings 350/1, 350/2, 352/1 and 352/2. The arm 378 is contiguous with the side wall 382 and the arm 376 is contiguous with the side wall 380. The radially inner edges 381 of these arms and side walls are at a given distance from the flow division 360 and together define the edges of lateral openings 338 for the lower flow-division chamber 334, and 340 for the upper flow-division chamber 336, which are in communication with mixing chambers 342 and 344 which are positioned on both sides of the flow-division chambers and extend in each tier over the entire height of both flow-division chambers 334 and 336. The mixing chambers 342 and 344 are defined by the tier floor 346, by a side wall 380 or 382, and an outer portion of the flow-division wall 360. The upper ends of the mixing chambers 342 and 344 are in communication with a passage opening 350/1, 350/2, 352/1 and 352/2 of the tier floor 346 of the adjacent upper tier as the adjacent higher tier is oriented at an angle of 90° with respect to the adjacent lower tier.

FIG. 14 shows the lowermost tier 302 of FIGS. 9 and 10 in perspective. FIG. 15 shows, in perspective, the lowermost tier 302, which extends from a tier floor 346 on its bottom to the tier floor 346 of the tier 303 of FIG. 1 located above it. FIG. 15 corresponds to the uppermost tier 308 of FIG. 9, displaced angularly by 90°.

As a result of the wedge-shaped design of the chambers and passage openings shown in FIGS. 9 to 15 and described above, the fluid branches of the mixed material are subjected both to a continuous change in cross-sectional shape of the various conduits and to a continuous change in passage cross-sectional size, which cause displacement of material within the various branches and individual branches so that the components are mixed together particularly well within the various stages of the apparatus. Improved mixing is achieved also by the fact that the fluid inputs to each tier impinge the flow division wall 360 which acts as baffle wall and are torn apart by the impact.

The chambers and openings are open towards the periphery of the mixing column 346 so that the mixer column can be manufactured in simple fashion by injection molding. The chambers and channels are closed off at the periphery when the mixing column 346 is inserted in the cylindrical housing 26 of the nozzle 22.

Figure 16:
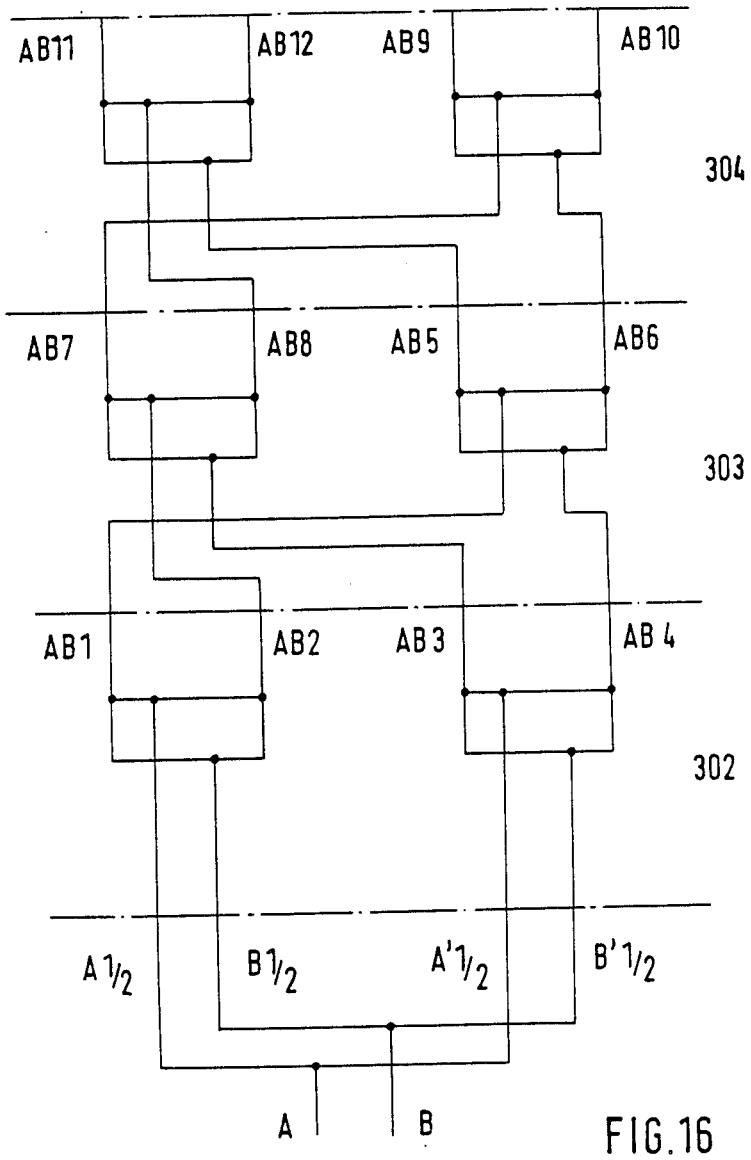
FIG. 16 is a schematic diagram of the mixing column illustrated in FIGS. 9 to 15.

FIG. 16 schematically illustrates the path of flow of two components A and B in tiers 302, 303 and 304. It can be noted therefrom that fluid inputs A and B of the two components are divided into individual branches A ½, A' ½, B ½, and B' ½ when the components enter through the passage openings 350/1, 350/2, 352/1, and 352/2 of the tier floor 346 of the lower tier 302 into said lower tier. In the individual tiers there is another division of these individual branches when these individual branches impinge the flow division wall 36 and are torn apart by the impact. These individual branches, produced by quadruple division, pass through the lateral openings 338 and 340 into the mixing chambers 342 and 344 positioned on either side of the flow-division chambers 334 and 336. The new branches thus formed pass from the mixing chambers through the passage openings of the next adjacent upper tier floor 346. Thus, there again commences a quadruple division of the new branches and a recombination into new combination of the four new branches.

FIGS. 9 to 16 thus illustrate an embodiment for quadruple division and remixing of the component branches of the material, which is preferred over the embodiment of FIGS. 7 and 8. FIGS. 1 to 6, however, cover a preferred embodiment for the double division in each case of component streams of the material.

Although the present invention has been described in connection with a plurality of preferred embodiments thereof, many other variations and modifications will now become apparent to those skilled in the art. It is preferred, therefore, that the present invention be limited not by the specific disclosure herein, but only by the appended claims.

We claim:

1. A static-mixing column for installation in a housing, for mixing of a plurality of liquid or pasty components of material received from reservoirs, comprising a plurality of tiers arranged one on top of another to form a column-like structure having an axis, where the plurality of tiers are open towards the circumferential periphery of the column, each tier having:

an entrance having at least two passage openings through which the material enters the tier;

at least two flow-division chambers at least partially positioned above one another and at least partially overlapping one another, each flow-division chamber having an input connected to a respective one of the passage openings through which the material enters the flow-division chamber, a flow-division wall placed for being contacted by the material flowing through the flow division chamber for dividing the incoming material, and two output openings through which the divided material exits the flow-division chamber; and an exit having mixing chambers positioned at and connected to the output openings of the flow-division chambers for mixing the material leaving the flow-division chambers;

where successive tiers are progressively shifted angularly with respect to each other around the axis of the column in the same direction of rotation, such that the mixing chambers of a lower tier are in communication with the passage openings of the next upwardly adjacent tier.

2. A static-mixing column according to claim 1 wherein all tier means are identical and where the uppermost tier means is provided with a cover.

3. A static-mixing column according to claim 2 wherein the tiers have generally "S"-shaped partition walls for separating the flow division chambers from each other.

4. A static-mixing column according to claim 3, wherein the flow-division walls are positioned substantially transverse to the direction of flow of material entering the flow division chambers.

5. A static-mixing column according to claim 4 wherein the at least two flow-division chambers and the mixing chambers have partition walls extending over the entire height of its respective tier creating at least two flow-division chamber subsections from each flow-division chamber and wherein each individual flow-division chamber subsection is connected to its own respective passage opening in the tier.

6. A static-mixing column according to claim 4, wherein each tier is divided into at least two adjacent regions such that each region has at least two of the flow-division chambers arranged substantially one above the other, mixing chambers situated on either side of the flow-division chambers, and lateral openings connecting each flow-division chamber to adjacent mixing chambers and wherein the two regions are separated from each other by a flow-division wall; and wherein each flow-division chamber is connected to its own unique passage opening.

7. A static-mixing column according to claim 6 wherein at least two of the regions within a tier are mirror images of each other.

8. A static-mixing column according to claim 6 or 7 wherein the flow-division chambers and the mixing chambers are generally tapered towards the axis of the column.

9. A static-mixing column according to claim 8, wherein each mixing chamber is each of the tiers extends over the entire height of both flow-division chambers adjacent to it in that tier.

* * * * *